US008246113B2

(12) United States Patent
Bock

(10) Patent No.: US 8,246,113 B2
(45) Date of Patent: Aug. 21, 2012

(54) OFFICE CHAIR OR OFFICE CHAIR COMPONENT WITH AN AERIAL TENSIONING ELEMENT

(75) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 124 days.

(21) Appl. No.: 12/779,361

(22) Filed: May 13, 2010

(65) Prior Publication Data

US 2010/0289320 A1 Nov. 18, 2010

(30) Foreign Application Priority Data

May 13, 2009 (DE) ..... 20 2009 006 921 U

(51) Int. Cl.
*A47C 31/02* (2006.01)
*A47C 31/04* (2006.01)

(52) U.S. Cl. ..... 297/218.1; 297/218.3; 297/218.5; 297/452.56; 297/452.58; 297/452.59

(58) Field of Classification Search ..... 297/218.1, 297/218.2, 218.3, 218.4, 218.5, 452.38, 452.56, 297/452.58, 452.59
See application file for complete search history.

(56) References Cited

U.S. PATENT DOCUMENTS 3,681,797 A * 8/1972 Messner ..... 297/452.45 X
3,747,178 A * 7/1973 Harder, Jr. ..... 297/218.4 X
3,924,893 A * 12/1975 Ferrara ..... 297/452.38 X
3,981,534 A * 9/1976 Wilton ..... 297/218.1
4,370,002 A * 1/1983 Koepke ..... 297/218.1
(Continued)

FOREIGN PATENT DOCUMENTS

| | | | |
|---|---|---|---|
| DE | 38 41 531 | A1 | 6/1990 |
| DE | 200 05 818 | U1 | 8/2001 |
| DE | 101 04 007 | C2 | 1/2003 |
| DE | 102 50 855 | B3 | 2/2004 |
| DE | 10 2005 028 569 | A1 | 12/2006 |

OTHER PUBLICATIONS

German Patent and Trademark Office Search Report, Dated Apr. 28, 2010.

*Primary Examiner* — Rodney B White
(74) *Attorney, Agent, or Firm* — Laurence A. Greenberg; Werner H. Stemer; Ralph E. Locher

(57) ABSTRACT

An office chair or office chair element, such as a backrest or seat, has a flat covering element, such as a fabric, cushioning or webbing element, secured to support elements, such as the arms of a support frame, and tensioned in between. The covering element is provided with a welt strip that, in the fitted state, is placed in an accommodating groove in the support element. The accommodating groove has two oppositely situated contact faces for the welt strip and one of the contact faces is provided with a projection that projects into the accommodating groove and extends in the longitudinal direction of the groove. The welt strip can be pressed into the accommodating groove, resiliently deforming the projection and/or the welt strip and the welt strip, in the fitted state, is positively locked and/or friction-locked in the groove with abutment against the contact faces, with the projection preventing the welt strip from escaping from the accommodating groove.

13 Claims, 3 Drawing Sheets

U.S. PATENT DOCUMENTS 4,385,783 A * 5/1983 Stephens ..... 297/452.57 X
4,740,034 A * 4/1988 Snyder et al. ..... 297/452.59
5,195,222 A 3/1993 Rink
6,378,944 B1 4/2002 Weisser
6,942,300 B2 9/2005 Numa et al.
7,401,829 B2 * 7/2008 Michalski et al. ... 297/452.62 X
2007/0018472 A1 * 1/2007 Michalski et al. ..... 296/1.08
2008/0203791 A1 8/2008 Hennig et al.

* cited by examiner

OFFICE CHAIR OR OFFICE CHAIR COMPONENT WITH AN AERIAL TENSIONING ELEMENT

BACKGROUND OF THE INVENTION

Field of the Invention:

The invention relates to an office chair or an office chair element, in particular a backrest or seat, including a flat covering element, in particular a fabric, cushioning or webbing element, which is secured to support elements, for example to the arms of a support frame, and is tensioned between the same.

Covering backrests and seats of office chairs with fabric, cushioning or webbing elements in order to obtain a surface for leaning against or sitting on are known in the prior art. Welting is often used to secure such covering elements, said welting being attached to an outside edge of the covering element and introduced into a welt groove provided on the support element. A disadvantage of this solution is that the welt is often not placed fixedly in the welt groove, but rather "escapes" from the welt groove, in particular if the user of the office chair places a heavy load on the covering element.

BRIEF SUMMARY OF THE INVENTION

It is an object of the present invention to secure the covering element in a reliable manner to the support element, in particular to prevent the welt escaping from the welt groove and to guarantee a defined fitting position for the welt.

This object is achieved through the invention provided in claim 1. Advantageous embodiments of the invention can be found in the subclaims.

A core idea of the invention is to use a strip-shaped welt element, which, in the fitted state, is placed in an accommodating groove that is realized on the support element, wherein a projection that extends in the longitudinal direction of the groove is provided in the accommodating groove and the welt strip is placed in the accommodating groove in a positive locking and/or force-locking manner, said welt strip being prevented from escaping by the projection. The welt strip is inserted into the accommodating groove by said welt strip being pressed into the accommodating groove, resiliently deforming the projection and/or the welt strip. To what extent projection and/or welt strip are deformable, is established by a suitable choice of material, as is familiar to the expert.

The invention creates a securing solution by means of which the welt is securely fixed in the accommodating groove. Even if the user of the office chair presents a heavy load on the covering element, the welt "escaping" from the welt groove is effectively prevented and a defined fitting position of the welt is ensured.

The welt strip is preferably an element with two oppositely situated side faces and two oppositely situated end faces, wherein the welt strip interacts with the accommodating groove in such a manner that, in the fitted state, the welt strip abuts against the contact faces of the accommodating groove by way of its side faces. To insert the welt strip into the accommodating groove, the welt strip is pressed into the accommodating groove with one of its end faces to the fore. It is particularly advantageous if the side faces are more than twice as wide as the end faces such that a characteristic strip shape is produced. This means that the welt strip can be inserted into the accommodating groove with its narrow side, which is advantageous for the fitting procedure. At the same time, the wider side faces form a particularly large abutment against the contact faces of the accommodating groove, which means that the welt strip is placed very securely in the accommodating groove and any tilting, canting or waggling of the welt strip is ruled out.

One embodiment of the invention has proved exceptionally advantageous, where the welt strip has a clamping strip, which extends in the longitudinal direction of the strip and consequently, at the same time, parallel to the longitudinal direction of the groove and, in the fitted state, abuts against the projection in the accommodating groove. The clamping strip, in this case, extends at a defined spacing from the end face of the welt strip which, in the fitted state, points out of the accommodating groove. In other words, the welt strip does not have to be inserted completely into the accommodating groove for fitting. Instead, it is sufficient for the welt strip to be inserted into the accommodating groove up to the point at which the projection engages behind the clamping strip. From this moment, the welt strip is no longer able to leave the accommodating groove just because of the load placed on the covering element. The use of the clamping strip is not only advantageous when the welt strip is being fitting into the accommodating groove. The position of the tensioning edge, over which the covering element or the welt rim is pulled, is not forcibly established by the accommodating groove in this case, but, depending on the embodiment, can also be defined by the length of the welt strip or the spacing between the clamping strip and the end face of the welt strip pointing out of the accommodating groove.

One embodiment of the invention is particularly advantageous for a permanently secure fitting position of the welt, where the accommodating groove is realized on the support element in such a manner that the angle between the direction of extraction of the welt strip from the accommodating groove and the tensioning direction of the covering element tensioned between the support elements is less than 90°. In other words, the accommodating groove is inclined relative to the tensioning direction in such a manner that overcoming the projection in the accommodating groove by extracting the welt strip in the direction of extraction is almost impossible, insofar as said projection abuts against the side face of the welt strip pointing in the tensioning direction. Correspondingly, in a preferred embodiment of the invention the projection is realized in such a manner that said projection, in the fitted state, abuts against the side face of the welt strip pointing in the tensioning direction.

The accommodating groove can be incorporated in the basic body of the support element. For example, a support element with the accommodating groove can be produced in an inexpensive manner as a plastics material injection-molded part. However, it is particularly advantageous when the accommodating groove is formed by a basic body of the support element for providing the one contact face of the accommodating grove, on the one hand, and by a profile element connected to the basic body for providing the other contact face of the accommodating groove on the other hand. Basic body and profile element, in this case, are preferably detachably interconnected, such that the opening and closing of the accommodating groove can be accomplished in a particularly simple manner by producing or releasing the connection between basic body and profile element. In the case of a two-part embodiment of this type of accommodating groove, the projection, corresponding to the above-described preferred embodiment, is realized on the contact face provided by the profile element, said contact face interacting with the side face of the welt strip that, in the fitted state, points in the tensioning direction.

Particularly reliable fixing of the welt strip in the accommodating groove is guaranteed when at least one side face of the welt strip is covered by a welt rim in such a manner that, in the fitted state, the welt rim abuts against at least one contact face of the accommodating groove. In other words, the width of the accommodating groove is established to match the width of the welt strip and the width of the welt rim in such a manner that the welt strip is placed fixedly between the contact faces of the accommodating groove when the welt rim is situated between at least one side face of the welt strip and a contact face of the accommodating groove. If the covering element itself serves as the welt rim, the fitting of the welt to the covering element is simplified. At the same time the covering has no potential weak point.

The covering element or the welt rim is preferably sewn to the welt strip. This means that there is none of the contamination of the elements involved that occurs when using an adhesive method and also that the use of an expensive ultrasound welding method is not necessary. Nevertheless, the necessary strength is guaranteed by the principle of securement according to the invention, in particular whenever the covering element or the welt rim is clamped between the welt strip and the accommodating groove.

An exemplary embodiment of the invention is described below by way of the drawings, in which, in detail:

DESCRIPTION OF THE INVENTION

All the figures just show the invention in a schematic manner with its essential components. Identical references in this case correspond to elements with an identical or comparable function.

Figure 1:
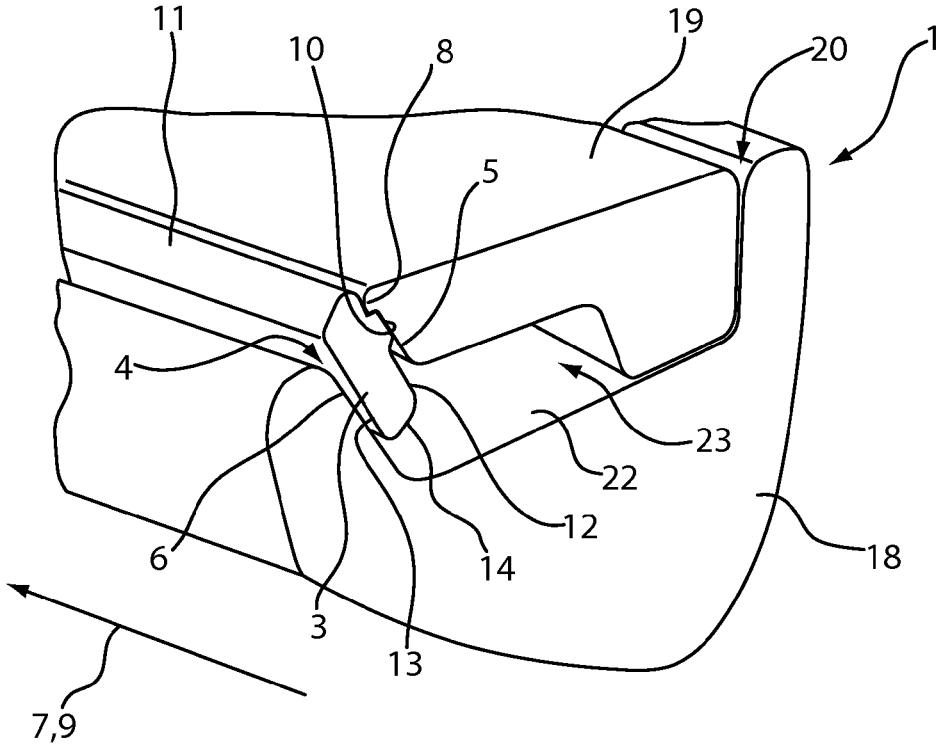
FIG. 1 shows a perspective representation of a section of a support element with a welt strip fitted.
Figure 2:
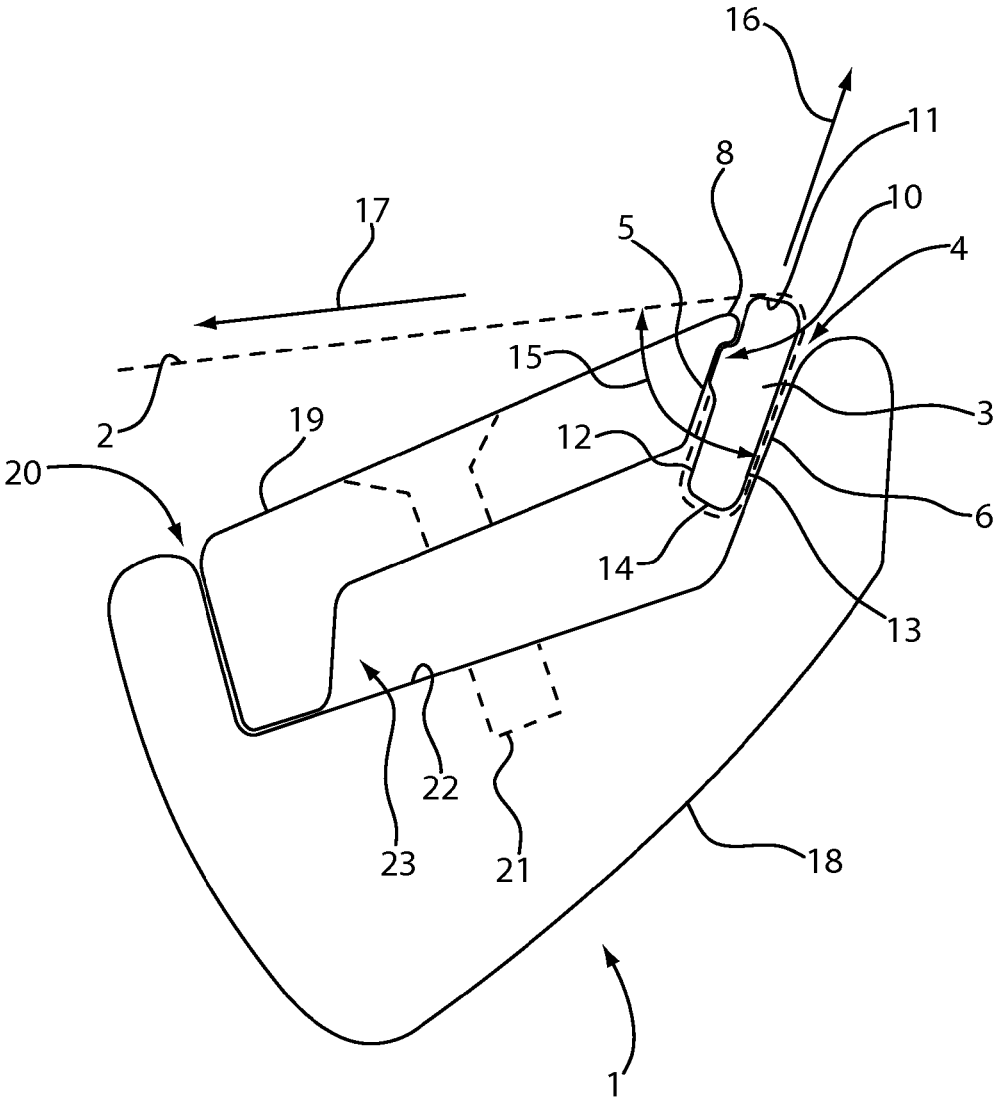
FIG. 2 shows the representation of a section through a support element with a welt strip fitted.

FIG. 1 shows a section of an arm 1 of a support frame of a backrest for an office chair. A webbing element 2 made of textile material is tensioned between the arm 1 shown and a further arm (not shown) of the support frame to make a so-called webbed back. To this end, the webbing element 2, the position of which is indicated in FIG. 2 by the broken line, is connected to the arm 1 using a strip-shaped welt 3. Other covering elements are, for example, cushioning elements made of leather or the like.

The welt strip 3 produced from a plastics material is attached to the outside edge of the webbing element 2 and, in the fitted state shown, is placed in an accommodating groove 4 that is realized on the arm 1. The accommodating groove 4 has two oppositely situated contact faces 5, 6, extending substantially parallel to one another, for the welt strip 3.

One of the contact faces 5 is provided with a projection 8, which projects into the accommodating groove 4 and extends in the longitudinal direction 7 of the groove.

In the embodiment represented, the welt strip 3 has a clamping strip 10, which extends in the longitudinal direction 9 of the strip and consequently parallel to the longitudinal direction 7 of the groove. In the fitted state, the clamping strip 10 abuts against the projection 8 in the accommodating groove 4. The clamping strip 10, in this case, extends at a defined spacing from an end face 11 of the welt strip 3 that protrudes out of the accommodating groove 4.

The welt strip 3 has two oppositely situated side faces 12, 13 and two oppositely situated end faces 11, 14. The side faces 12, 13 of the welt strip 3 are more than twice as wide as its end faces 11, 14. The welt strip 3 interacts with the accommodating groove 4 in such a manner that said welt strip, in the fitted state, abuts against the contact faces 5, 6 of the accommodating groove 4 by way of its side faces 12, 13. To insert the welt strip 3 into the accommodating groove 4, the welt strip 3 is pressed with its end face 14 to the fore into the accommodating groove 4, resiliently deforming the projection 8 and/or the clamping strip 10. In the fitted state, the welt strip 3 abuts against the contact faces 5, 6 and is placed in the accommodating groove 4 in a positive locking and/or force-locking manner, being prevented from escaping in the extraction direction 16 by the projection 8.

The accommodating groove 4 is realized on the arm 1 in such a manner that the angle 15 between the direction of extraction 16 of the welt strip 3 from the accommodating groove 4 and the tensioning direction 17 of the webbing element 2 tensioned between the arms 1 is less than 90°. The projection 8 abuts against the side face 12 of the welt strip 3 pointing in the tensioning direction 17.

The accommodating groove 4 is formed by a basic body 18 of the arm 1 and a profile element 19 that is connected to the basic body 18 and serves as a webbing frame. In this case, the basic body 18 provides the one contact face 6 of the accommodating groove 4, whilst the profile element 19 provides the other contact face 5 of the accommodating groove 4. The basic body 18 and the profile element 19, in this case, are each produced from a plastics material. The projection 8 is realized on the contact face 5 provided by the profile element 19, said contact face interacting with the side face 12 of the welt strip 3 that, in the fitted state, points in the tensioning direction 17 of the webbing element 2.

The basic body 18 forms a substantially U-shaped accommodating means 20, into which the profile element 19 is placed. Basic body 18 and profile element 19 are detachably interconnected by means of screw connections 21. In the fitted state, the profile element 19 almost fills out the accommodating means 20. For the purposes of saving material, the profile element 19 is provided with chambers 23, which point in the direction of the U-base 22 of the accommodating means 20 and are interrupted at certain spacings by stabilizing webs (not shown), which ensure that the profile element 19 is fixedly supported on the U-base 22 of the accommodating means 20.

Figure 3:
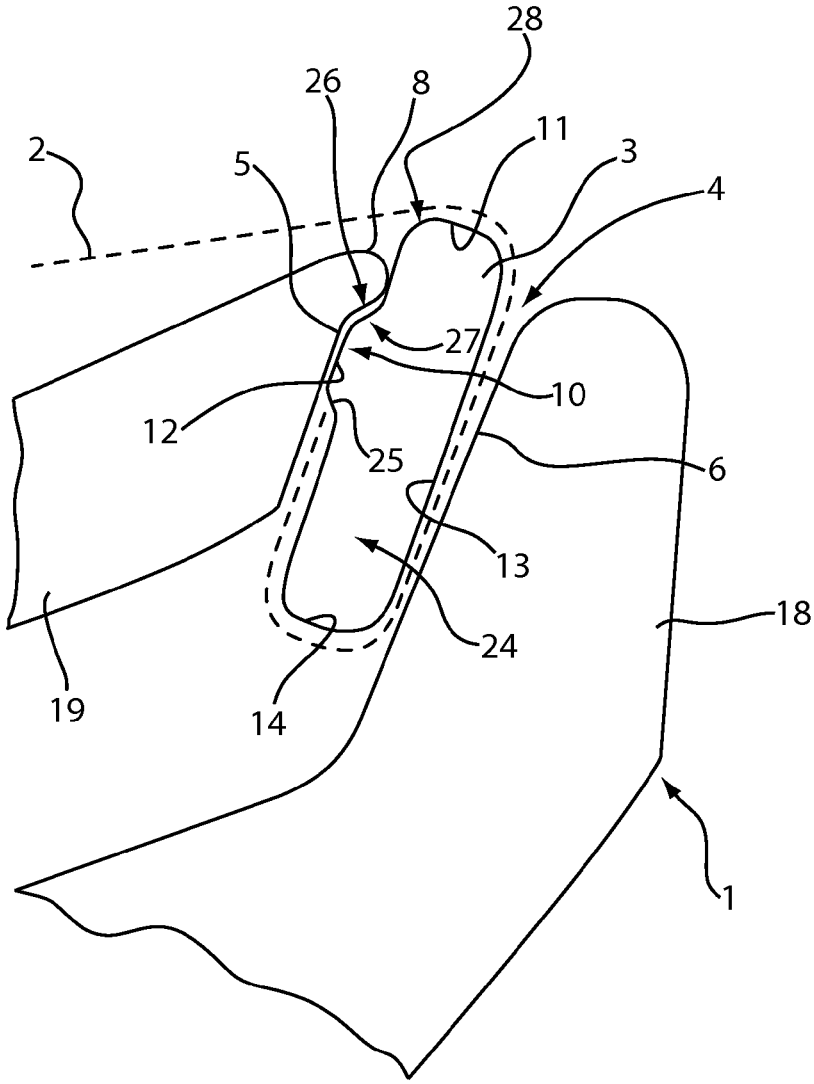
FIG. 3 shows the view of a detail in FIG. 2.

Once profile element 19 and basic body 18 have been interconnected, the welt strip 3 can be fitted. To this end, the welt strip 3 is slid with its one end face 11 to the fore into the accommodating groove 4 against the direction of extraction 16 defined by the position of the accommodating groove 4. At the same time projection 8 and/or clamping strip 10 deform resiliently until the projection 8 is pushed away beyond the clamping strip 10. To this end, a run-up inclination 25 can be provided on the bottom edge of the clamping strip 10. Once the projection 8 has slid over the clamping strip 10 and has engaged behind said clamping strip, the welt strip 3 is situated in its fitting end position, in which the projection 8 abuts against the clamping strip 10 and fixes the welt strip 3 in the accommodating groove 4. The underside 26 of the projection 8 facing the clamping strip 10, in this case, is provided with an inclination, which corresponds substantially to the contact inclination 27 of the clamping strip 10 for the projection 8, cf. FIG. 3. At the same time, the length of the projection 8 protruding into the accommodating groove 4 corresponds substantially to the depth of the clamping strip 10 protruding from the basic body 24 of the welt strip 3, such that projection 8 and clamping strip 10 abut against each other in a flat manner in the fitted state. The clamping strip 10, the contact inclination 27 of which for the projection 8 is at a spacing from the upper end face 11, does not extend over the entire remaining side face 12 of the welt strip 3. Instead, it abuts only against a part of the contact face 5 defined by the profile element 19. Approximately half of the side face 12 of the welt strip 3 pointing in the tensioning direction 17 is not provided with the clamping strip 10, such that the welt strip 3, beginning at the run-up inclination 25 forming the bottom closure of the clamping strip 10 on the side face 12 pointing in the tensioning direction 17 over the end face 14 pointing into the accommodating groove 4, the side face 13 pointing away from the tensioning direction 17 and the end face 14 pointing out of the accommodating groove 4, is sewn to the webbing element 2, which consequently serves at the same time as the welt rim. The end face 11 of the welt strip 3 pointing out of the accommodating groove 4 consequently forms the tensioning edge 28, against which the webbing element 2 abuts for tensioning.

The width of the accommodating groove 4 is established to match the width of the welt strip 3 and the width of the webbing element 2 in such a manner that, in the fitted state, the welt strip 3 is placed fixedly between the contact faces 5, 6 of the accommodating groove 4. In this case, the webbing element 2 is clamped between the welt strip 3 and the contact face 6 of the accommodating groove 4. If the width of the webbing element 2 also corresponds in addition to the depth of the clamping strip 10, the webbing element 2 is also clamped between the welt strip 3 and the contact face 5 of the accommodating groove.

All the features represented in the description, the following claims and the drawing can be essential to the inventive step either individually or in arbitrary combination with each other.

LIST OF REFERENCES

1 Arm
2 Webbing element
3 Welt strip
4 Accommodating groove
5 Contact face
6 Contact face
7 Longitudinal direction of the groove
8 Projection
9 Longitudinal direction of the strip
10 Clamping strip
11 End face
12 Side face
13 Side face
14 End face
15 Angle
16 Direction of extraction
17 Tensioning direction
18 Basic body
19 Profile element
20 Accommodating means
21 Screw connection
22 U-base
23 Chamber
24 Basic body
25 Run-up inclination
26 Underside
27 Contact inclination
28 Tensioning edge

The invention claimed is:

1. An office chair assembly, comprising:

a support element having an accommodating groove formed therein;

an areal covering element to be secured to said support element and tensioned at said support element;

said covering element carrying at least one welt strip on a marginal edge thereof, said welt strip being configured for placement, in a fitted state of said areal covering element, in said accommodating groove in said support element;

said accommodating groove having two mutually opposite contact faces and a projection formed on one of said contact faces, projecting into said accommodating groove, and extending along a longitudinal direction of said groove;

said welt strip and said accommodating groove being configured such that at least one of said projection and said welt strip is resiliently deformed when said welt strip is pressed into said accommodating groove; and wherein said welt strip, in the fitted state of said areal covering element, is retained in said accommodating groove in a positive lock and/or a force-lock, with said welt strip abutting against said contact faces, and said welt strip being prevented from escaping from said accommodating groove by said projection.

2. The assembly according to claim 1, configured as an office chair or a part of an office chair.

3. The assembly according to claim 1, configured as a backrest or a seat of an office chair.

4. The assembly according to claim 1, wherein said areal covering element is a fabric, a cushioning element, or a webbing element.

5. The assembly according to claim 1, wherein said support element is formed by arms of a support frame of an office chair and said covering element is tensioned between said arms.

6. The assembly according to claim 1, wherein said welt strip has two oppositely situated side faces and two oppositely situated end faces, wherein said welt strip is insertable into said accommodating groove by said welt strip being pressed with one of said end faces facing into said accommodating groove, and in the fitted state, by way of said side faces abutting against said contact faces of said accommodating groove.

7. The assembly according to claim 1, wherein said welt strip is formed with a clamping strip extending in the longitudinal direction of said welt strip and, in the fitted state, abutting against said projection.

8. The assembly according to claim 1, wherein said accommodating groove is formed on said support element to define an angle of less than 90° between a direction of extraction of said welt strip from said accommodating groove and a tensioning direction of said covering element tensioned between said support elements.

9. The assembly according to claim 8, wherein said projection is configured to, in the fitted state, abut against said side face of said welt strip pointing in the tensioning direction.

10. The assembly according to claim 1, wherein said accommodating groove is formed between a basic body of said support element, defining one of said two contact faces of said accommodating groove, and a profile element connected to said basic body of said support element, defining the other of said two contact faces of said accommodating groove.

11. The assembly according to claim 10, wherein said profile element is detachably connected to said basic body.

12. The assembly according to claim 1, wherein at least one side face of said welt strip is covered with a welt rim which, in the fitted state, abuts against at least one contact face of the accommodating groove.

13. The assembly according to claim 12, wherein said covering element is said welt rim.

* * * * *